United States Patent [19]

Henmi et al.

[11] Patent Number: 4,989,375

[45] Date of Patent: Feb. 5, 1991

[54] GRINDING WHEEL HAVING HIGH IMPACT RESISTANCE, FOR GRINDING ROLLS AS INSTALLED IN PLACE

[75] Inventors: Yoshinori Henmi, Komaki; Akira Tanabe, Kasugai; Kouichi Saburi, Aichi; Kanji Hayashi, Hiroshima; Takayuki Goto, Yokohama; Hisao Matsushima, Hiroshima, all of Japan

[73] Assignees: Noritake Co., Limited, Aichi; Mitsubishi Jukogo Kabushiki Kaisha, Tokyo, both of Japan

[21] Appl. No.: 354,983

[22] Filed: May 19, 1989

[30] Foreign Application Priority Data

| | | | |
|---|---|---|---|
| May 28, 1988 | [JP] | Japan | 63-131217 |
| May 28, 1988 | [JP] | Japan | 63-131218 |
| May 28, 1988 | [JP] | Japan | 63-131219 |
| May 28, 1988 | [JP] | Japan | 63-131220 |

[51] Int. Cl.[5] ..... B24D 7/14

[52] U.S. Cl. ..... 51/209 R; 51/207; 51/206 NF

[58] Field of Search ..... 51/206 R, 206 NF, 207, 51/209, 298, 297

[56] References Cited

U.S. PATENT DOCUMENTS

| | | | |
|---|---|---|---|
| 1,394,704 | 10/1921 | Barnhart | 51/51 |
| 1,403,416 | 1/1922 | Katzenstein | 51/206 R |
| 2,763,105 | 9/1956 | Freeley | 51/207 |
| 2,877,105 | 3/1959 | Smith | 51/206 R |
| 4,716,687 | 1/1988 | Tsukamoto et al. | 51/131.1 |

FOREIGN PATENT DOCUMENTS

| | | |
|---|---|---|
| 61-140312 | 6/1986 | Japan . |
| 61-154706 | 7/1986 | Japan . |
| 61-164772 | 7/1986 | Japan . |
| 62-127109 | 6/1987 | Japan . |
| 63-60009 | 3/1988 | Japan . |
| 63-108906 | 5/1988 | Japan . |

*Primary Examiner*—Robert A. Rose

*Attorney, Agent, or Firm*—Oliff & Berridge

[57] ABSTRACT

A grinding wheel having a circular outer periphery, and a working front end face for grinding a roll as installed in place on a rolling mill or other equipment, such that the front end face is held in pressed frictionally sliding contact with an outer circumferential surface of the roll. The wheel has an annular first abrasive member, and one or two annular second abrasive member(s) which is/are formed integrally with the first abrasive member, and disposed on corresponding at least one of the radially outward and inward sides of the first abrasive member. Each second abrasive member comprises a bonding agent different from that of the first abrasive member, and has a lower modulus of elasticity than the first abrasive member. Also disclosed is a grinding wheel which has a single abrasive body whose outer and/or inner circumferential surface(s) is/are tapered such that the radial wall thickness decreases in an axial direction toward the working end face. The abrasive body may preferably contain short glass, carbon or alumina fibers.

13 Claims, 9 Drawing Sheets

FIG. 5
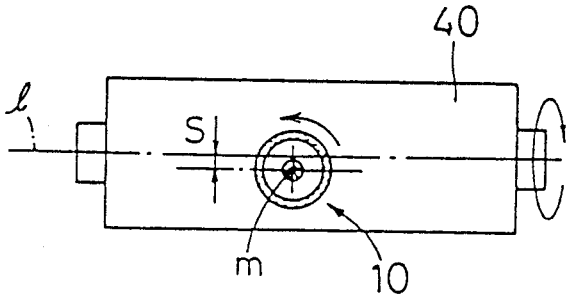
FIG. 6
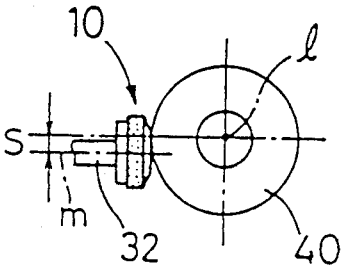
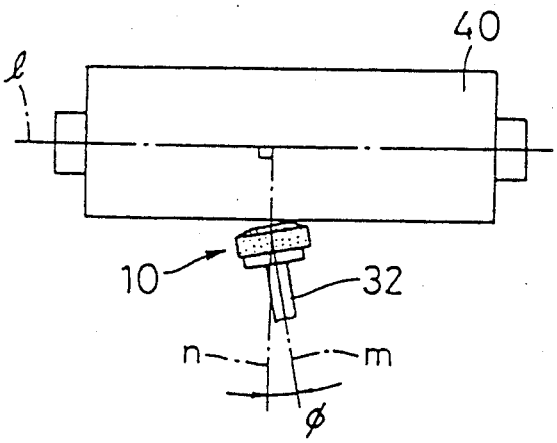
FIG. 7
FIG. 8
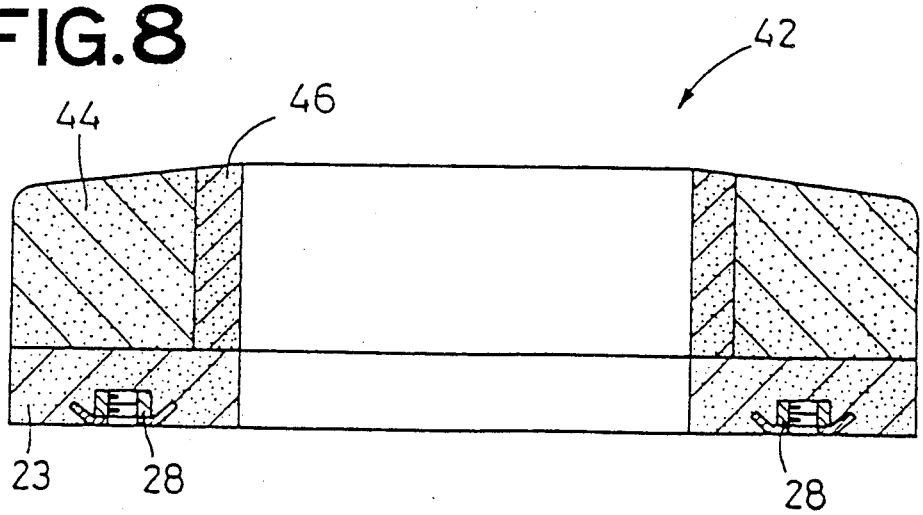

GRINDING WHEEL HAVING HIGH IMPACT RESISTANCE, FOR GRINDING ROLLS AS INSTALLED IN PLACE

BACKGROUND OF THE INVENTION

1. Field of the Invention

The present invention relates generally to a grinding wheel used for grinding the outer circumferential surface of a roll as installed on given equipment, and more particularly to such a grinding wheel which has high impact or shock resistance and which is less likely to chip or be otherwise damaged.

2. Discussion of the Prior Art

Rolling surfaces of working rolls on a rolling mill, for example, may be roughened due to rolling contact with workpieces such steel ingots, billets and slabs, or locally excessively worn at the opposite end portions which contact the lateral end portions of the workpieces. Similar wearing conditions are encountered on other types of rolls such as back-up rolls which are provided for backing up the working rolls. Therefore, the outer circumferential surfaces of such rolls need to be ground to desired smoothness. To this end, there has been proposed a so-called "on-line" grinding method, in which a roll is ground by a cylindrical grinding wheel, for example, while the roll is installed on a rolling mill stand. In this instance, the grinding is effected such that the grinding wheel is negatively rotated by a rotating movement of the roll, or positively rotated by suitable drive means such as a motor, while the working end face of the wheel is held in pressed frictionally sliding contact with the outer circumferential surface of the roll. Typical examples of such a method and grinding devices for practicing the method are disclosed in laid-open Publication Nos. 61-140312, 61-154706 and 62-127109 of unexamined Japanese Patent Applications. According to the "on-line" grinding method disclosed therein, the rolls may be ground with higher efficiency, with a result of higher operating efficiency or productivity of the rolling mill, than in the case where the rolls are ground after they are removed from the rolling mill. The grinding devices disclosed in the above Publication Nos. 61-140312 and 61-154706 are adapted such that the grinding wheel is negatively rotated by the rotation of the roll to be ground, while the grinding device disclosed in the above Publication No. 62-127109 is of the type in which the grinding wheel is positively rotated by a drive motor In a common "on-line" grinding as described above, a plurality of grinding wheels are arranged in a line parallel to the axis of rotation of the roll, such that the grinding wheels are spaced apart from each other, and the grinding is conducted while the wheels are reciprocated in the axial direction of the roll.

When the "on-line" grinding is effected while the roll is engaged in a rolling process, the grinding wheel may suffer from chipping, cracking or other damages at the radially outer peripheral edge portion of the grinding end face, due to vibrations of the roll in the process of rolling a workpiece, or due to collision of the grinding wheel with irregular stepped or raised portions or protrusions formed on the rolling surface of the roll, which arise from local wearing of the rolling surface.

SUMMARY OF THE INVENTION

It is accordingly an object of the present invention to provide a grinding wheel for grinding a roll as installed on a rolling mill or other equipment, which grinding wheel is suitably protected against chipping, cracking or other damage, during grinding of the rolling surface having stepped or raised portions.

The above object may be accomplished according to one aspect of the present invention, which provides a grinding wheel having a circular outer periphery, and a working front end face for grinding a roll as installed in place for operation, such that the front end face is held in pressed frictionally sliding contact with an outer circumferential surface of the roll, comprising: a first abrasive member having an annular shape; and at least one second abrasive member having an annular shape, formed integrally with the first abrasive member, and disposed on corresponding at least one of radially outward and inward sides of the first abrasive member. Each of the at least one second abrasive member comprises a mass of abrasive grains, and a bonding agent for bonding together the abrasive grains. The bonding agent of each second abrasive member is different from a bonding agent for bonding together abrasive grains of the first abrasive member. Each second abrasive member has a lower modulus of elasticity than the first abrasive member.

In the grinding wheel of the present invention which has the first abrasive member and at least one second abrasive member having a lower modulus of elasticity, as described above, the first abrasive member having a comparatively high modulus of elasticity assures a sufficiently high grinding function. On the other hand, the second abrasive member or members with the comparatively lower modulus of elasticity, which is/are radially inwardly or outwardly, or radially inwardly and outwardly of the first abrasive member, is/are highly resistant to shock or impact applied thereto at the radially outer or inner edge or radially outer and inner edges. Each second abrasive member is therefore less likely to suffer from chipping, cracking or other damages, due to vibrations of the roll being ground, or due to collision of the grinding wheel with irregular raised or stepped portions on the outer circumferential surface of the roll Hence, the instant grinding wheel permits efficient grinding of the roll as installed in place for operation, without conventionally experienced chipping or cracking at its edge portion.

The second abrasive member is provided on at least one of the radially inward or outward sides of the first abrasive member, depending upon the specific manner of grinding by the grinding wheel. More particularly, the portion of the grinding wheel which tends to be damaged varies with the operating parameters of the grinding wheel, which include the amount of offset of the axis of the wheel relative to the rotation axis of the roll, the angle of inclination of the wheel axis with respect to a plane perpendicular to the roll axis. Thus, one of the following three configurations in terms of the number and position of the at least one second abrasive member is suitably selected: one second abrasive member disposed radially outwardly of the first abrasive member; one second abrasive member disposed radially inwardly of the first abrasive member; and two second abrasive members disposed radially outwardly and inwardly of the first abrasive member, respectively.

For enabling the first abrasive member to provide practically sufficient grinding capability, it is desirable that the modulus of elasticity of the first abrasive member be held within a range of 2000–7000 kgf/mm$^2$. To this end, the first abrasive member is preferably constituted by: a vitrified-bond wheel in which abrasive grains such as $Al_2O_3$ (alumina), SiC, CBN and diamond are bonded together by an inorganic bonding agent such as feldspar, pottery stone and refractory clay; a metal-bond wheel which uses a metallic bonding agent; or some species of a resinoid-bond wheel.

The second abrasive member has a higher degree of shock or impact resistance than a conventional grinding wheel, provided the modulus of elasticity of the second abrasive member is lower than that of the first abrasive member. Preferably, the modulus of elasticity of the each second abrasive member is selected within a range of 100–1000 kgf/mm$^2$. To this end, the second abrasive member may consist of a resinoid-bond wheel in which abrasive grains of $Al_2O_3$, SiC, CBN and diamond are bonded together by phenol resin, epoxy resin, polyvinyl alcohol resin, or other resin bond, or alternatively a rubber-bond wheel which uses natural or synthetic rubber. The use of such a resinoid-bond wheel or rubber-bond wheel enables the second abrasive member to be highly resistant to chipping, cracking or other damages.

Where the at least one second abrasive member consists of a single second abrasive member which is bonded to an outer circumferential surface of the first abrasive member, a volume of the single second abrasive is preferably held within a range of 5–50% of a total volume of the first abrasive member and the single second abrasive member. In this case, the grinding wheel provides practically satisfactory levels of grinding capability and impact resistance If the volume of the second abrasive member is less than 5% of the total volume of the wheel, the impact resistance tends to be insufficient. If the volume exceeds 50%, the grinding wheel may suffer from insufficient grinding capacity. Since the grinding capacity and the impact resistance are considerably influenced by the total wall thickness of the grinding wheel, the above volumetric ratio is determined based upon the size of the grinding wheel.

The second abrasive member may contain evenly distributed short fibers, such as glass fibers, carbon fibers and $Al_2O_3$ fibers, as a material for improving the mechanical properties including the impact resistance, whereby the second abrasive member is effectively protected against chipping or cracking. Further, the short fibers improve the toughness and rigidity of the second abrasive member, thereby permitting reduction in the required working surface which contacts the roll. Since the short fibers may be more easily evenly distributed, than long fibers, the mechanical properties may be improved uniformly throughout the mass of the second abrasive member, i.e., without specific directionality in the mechanical properties. Where the coefficient of thermal expansion of the short fibers is lower than that of the bonding agent, the elastic deformation of the second abrasive member due to the thermal expansion may be restricted.

The short fibers preferably have a length within a range of 1–10 mm. With the length exceeding 10 mm, the short fibers tend to be entangled and difficult to be evenly distributed when the fibers are mixed in the material of the abrasive member, whereby some directionality of the mechanical properties of the abrasive member may appear. If the length of the short fibers is shorter than 1 mm, the fibers do not sufficiently contribute to the improvement in the impact resistance of the second abrasive member, though the evenness of distribution is enhanced. It is desirable that the short fibers consist of a plurality of bundles, each bundle consisting of 50–500 fibers, for example. This permits easy mixing procedure and even distribution of the short fibers, and facilitates counting of the number of the short fibers necessary to assure the desired mechanical strength of the abrasive member. It is desirable that the diameter or thickness of the glass fibers be about 5–10 microns, that of the carbon fibers be about 3–15 microns, and that of the alumina fibers be about 1–15 microns. However, the length, diameter and number of the fibers of each bundle are not limited to those indicated above, but may be suitably changed, depending upon the abrasive grains and bonding agent of the second abrasive member.

The first and second abrasive members may be separated at their interface, and the second abrasive member may be displaced relative to the first abrasive member in the axial direction toward the working front end face, due to a difference in the amount of elastic deformation between the first and second abrasive members upon pressed contact with the roll, due to a difference in the thermal expansion coefficient between the first and second abrasive members, due to vibrations of the roll, or due to collision of the grinding wheel with raised or stepped portions on the outer surface of the roll. To prevent the above displacement, it is desirable that the bonded circumferential surfaces of the first abrasive member and the second abrasive member have recessed and raised portions which engage each other, or alternatively, the bonded circumferential surfaces be tapered such that diameters of the tapered bonded circumferential surfaces increases in an axial direction of the wheel toward the front end face. More desirably, the bonded circumferential surfaces have the recessed and raised portions, and are tapered as indicated above. The above arrangements restrict the relative displacement or separation of the first and second abrasive members, or prevent the complete removal of the second abrasive member from the first abrasive member even if the first and second abrasive members are more or less displaced relative to each other. Thus, high safety of operation of the grinding wheel is assured.

For perfect prevention of the removal of the second abrasive member, an angle of taper of the tapered bonded circumferential surfaces of the first and second abrasive members is desirably 1° or more, depending upon the bonding strength of the first and second abrasive members. The area of the front end surface and the grinding capacity of the grinding wheel suddenly decrease as the front end surface is worn, if the taper angle is excessively large. Therefore, the taper angle should be determined so as to provide an optimum compromise between the prevention of removal of the second abrasive member and the grinding capacity of the grinding wheel. The taper angle is selected generally within a range of 1°–40°, and preferably within a range of about 2°–6°.

For improving the impact resistance of the edge portion of the second abrasive member, at least one of inner and outer circumferential surfaces of the second abrasive member which is not bonded to the first abrasive member may be tapered such that the total radial wall thickness of the first and second abrasive members decreases in an axial direction of the wheel toward the front end face. In this case, the angle of the edge portion defined by the front end face and the tapered circumferential surface is made larger, and the impact resistance to chipping or cracking is increased. While the impact resistance increases with the taper angle, the area of the front end face decreases with the taper angle. To assure sufficient grinding capability and avoid a sudden decrease in the grinding surface area while assuring improved impact resistance of the second abrasive member, the taper angle of the above-indicated at least one circumferential surface of the second abrasive member should not exceed 60°, and is usually in the neighborhood of 20°, though the optimum taper angle varies depending upon the material and modulus of elasticity of the second abrasive member.

The circumferential surface of the second abrasive member which is bonded to the first abrasive member need not be tapered, i.e., may be a cylindrical surface whose axis is parallel to the axis of the grinding wheel. However, this circumferential surface may also be tapered at substantially the same taper angle as the other circumferential surface not bonded to the first abrasive member, so that the second abrasive member has a substantially constant radial wall thickness. Where both of the inner and outer circumferential surfaces of the second abrasive member are tapered, the second abrasive member may be removed from the first abrasive member in the axially frontward direction if the bonded surfaces are separated from each other. To avoid this, it is desirable that the bonded circumferential surfaces of the first and second abrasive members have recessed and raised portions which engage each other.

The object described above may also be accomplished according to another aspect of the present invention, which provides a grinding wheel having a circular outer periphery, and a working front end face for grinding a roll as installed in place for operation, such that the front end face is held in pressed frictionally sliding contact with an outer circumferential surface of the roll, the grinding wheel comprising an annular abrasive member having inner and outer circumferential surfaces at least one of which is tapered such that a radial wall thickness of the abrasive member decreases in an axial direction toward the front end face.

In the grinding wheel according to the above aspect of the invention, the angle of the edge defined by the front end face and the tapered inner or outer circumferential surface, or the angles of the edges defined by the front end face and the tapered inner and outer circumferential surfaces is/are made comparatively large, whereby the edge or edges has/have improved impact resistance. Thus, the annular abrasive member permits a grinding operation of the roll as installed in place, without chipping, cracking or other damages to the edge portion or portions of the abrasive member, like the grinding wheel which includes the first and second abrasive members, as described above.

According to the present form of the invention, only the inner or outer circumferential surface or both of the inner and outer circumferential surfaces of the abrasive member is/are tapered, depending upon the specific manner of grinding, i.e., the grinding conditions which include the amount of offset of the grinding wheel relative to the axis of the roll, and the angle of inclination of the wheel axis with respect to a plane perpendicular to the roll axis. The impact resistance of the edge portion increases with an increase in the angle of taper of the inner and/or outer circumferential surface(s). While the optimum taper angle varies depending upon the material and modulus of elasticity of the abrasive member, the taper angle is generally at least 50°, preferably at least 60°. However, provided the minimum required impact resistance is provided, the taper angle should be as small as possible, because an increase in the taper angle results in reducing the area of the working front end face and therefore the grinding capacity, and results in increasing the rate at which the area of the front end face (grinding capacity) decreases as the grinding wheel is worn. In this respect, the taper angle is selected within a range of 50°-80°, and is preferably set around 60°.

For assuring practically sufficient grinding capacity, the abrasive member may be preferably constituted by: a vitrified-bond wheel wherein abrasive grains such as $Al_2O_3$, SiC, CBN and diamond are bonded together by an inorganic bonding agent such as feldspar, pottery stone and refractory clay; a metal-bond wheel which uses a metallic bonding agent; or some specifies of a resinoid-bond wheel which have comparatively low modulus of elasticity.

The object of the invention may also be attained according to a further aspect of the invention, which provides a grinding wheel having a circular outer periphery, and a working front end face for grinding a roll as installed in place for operation, such that the front end face is held in pressed frictionally sliding contact with an outer circumferential surface of the roll, the grinding wheel comprising an annular abrasive member containing evenly distributed short fibers.

In the grinding wheel described above, the uniformly distributed short fibers improve the mechanical properties including the impact resistance to chipping, cracking or other damages, without deteriorating the "on-line" grinding capacity of the abrasive member. The short fibers may be glass fibers, carbon fibers or alumina fibers, which are contained in the abrasive member preferably in the form of bundles each consisting of a multiplicity of fibers having a length of 1-10 mm. This form assures even distribution of the short fibers, improvement of the impact resistance of the abrasive member, and easy mixing of the fibers in the material of the abrasive member. As previously indicated, it is desirable that each bundle consists of 50-500 fibers, and the length of the fibers be held in the following ranges: about 5-10 microns in the case of glass fibers; about 3-15 microns in the case of the carbon fibers; and 1-15 microns in the case of the $Al_2O_3$ fibers. According to this aspect of the invention, the abrasive member is preferably constituted by a resinoid-bond wheel or a rubber-bond wheel, rather than a vitrified-bond wheel, from the standpoint of impact resistance of the grinding wheel.

BRIEF DESCRIPTION OF THE DRAWINGS

The foregoing and other objects, features and advantages of the present invention will be better understood by reading the following detailed description of presently preferred embodiments of the invention, when considered in connection with the accompanying drawings, in which:

FIGS. 5, 6 and 7 are a front and a right-hand side end elevational view, and a plan view, respectively, illustrating a condition in which the grinding wheel of FIG. 1 is used for grinding a roll of a rolling mill;

FIGS. 8–14 are views illustrating other embodiments of the present invention;

DETAILED DESCRIPTION OF THE PREFERRED EMBODIMENTS

Figure 1:
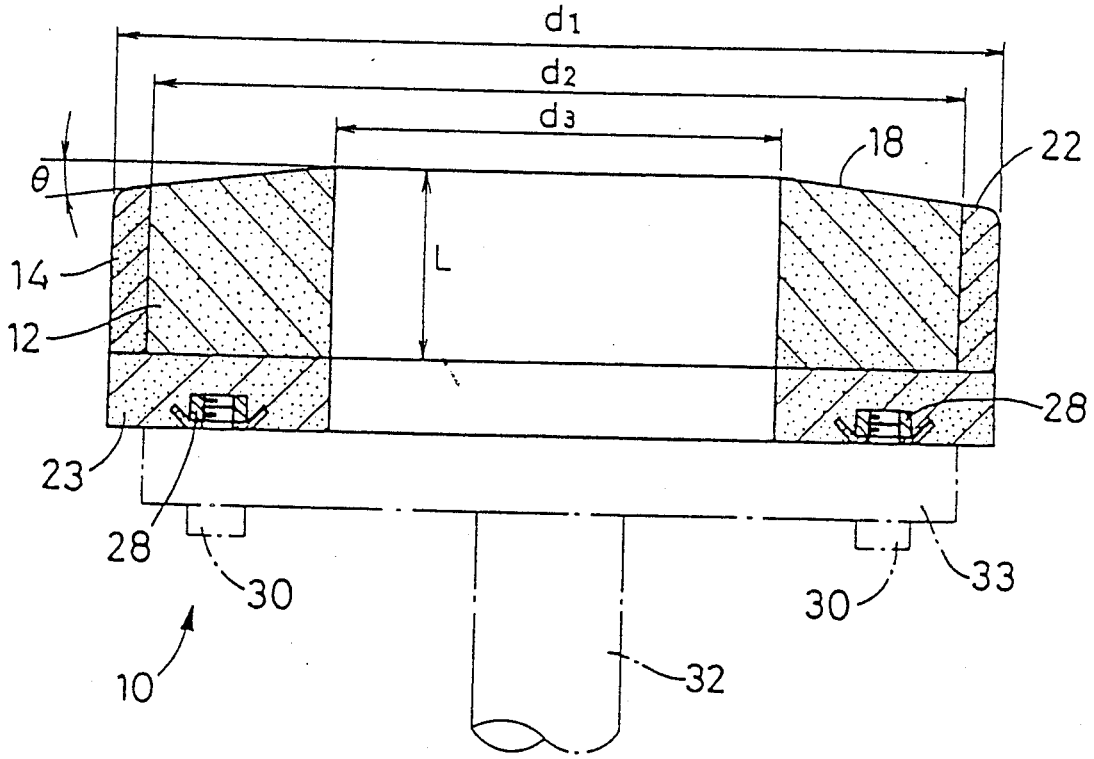
FIG. 1 is an elevational view in axial cross section of one embodiment of a grinding wheel for grinding rolls as installed on a rolling mill.

Referring first to FIG. 1, reference numeral 10 generally denotes a grinding wheel which is constructed according to one embodiment of the present invention, for effecting on the-spot rolling of grinding rolls as installed on hot-rolling mill stands arranged in a line, while the rolls are engaged or not engaged in a rolling process. The grinding wheel 10 has a circular outer periphery and includes an annular or cylindrical inner abrasive member 12, and an annular or cylindrical outer abrasive member 14 which is disposed radially outwardly of and integrally with the inner abrasive member 12. The inner abrasive member 12 is a vitrified-bond wheel which uses a vitrified bond such as feldspar, pottery stone, refractory clay and other inorganic substances. The modulus of elasticity of the inner abrasive member 12 is selected within a range of 2000–7000 kgf/mm$^2$, preferably in the neighborhood of 5000 kgf/mm$^2$, by controlling the proportion of abrasives such as $Al_2O_2$, SiC, CBN and diamonds, and the above-indicated vitrified bond. For example, GC320K8V and PA220L8V according to the grinding wheel identification of the Japanese Industrial Standards (JIS), or CB170M100VN1 (CONCENTRATION 100) may be suitably used as the inner abrasive 12. The inner abrasive 12 has a working annular front end face 18 which is inclined by an angle $\theta$ with respect to a plane perpendicular to the axis of the wheel 10, such that the axial distance between the front end face 18 and the rear end face decreases in the radially outward direction. The inner abrasive 12 constructed as described above functions as a first abrasive member of the grinding wheel 10.

On the other hand, the outer abrasive member 14 is a resinoid-bond wheel which uses a resinoid or plastic bond such as expoxy resin. The modulus of elasticity of this outer abrasive member 14 is selected within a range of 100–1000 kgf/mm$^2$, preferably in the neighborhood of 600 kgf/mm$^2$, by controlling the proportion of the abrasive such as $Al_2O_3$, SiC, CBN and diamonds, and the resinoid bond. For example, GC220J8BY and WA220J8BY (JIS) or CBNC220J100BY may be suitably used as the outer abrasive member 14. The outer abrasive member 14 has a working annular front end face 22 which is inclined such that the end faces 18 and 22 cooperate with each other to form a straight surface. The radially outer edge of the front end face 22 of the outer abrasive member 14 is rounded to an arc radius of about 5 mm. This outer abrasive 14 functions as a second abrasive member which uses the bonding agent (resinoid bond) different from that (vitrified bond) of the first abrasive member 12, and whose modulus of elasticity is lower than that of the first abrasive member 12.

The outer or second abrasive member 14 includes evenly distributed short fibers of glass, carbon, $Al_2O_3$ or other suitable materials, as a reinforcing material for increasing its impact resistance and avoiding deformation due to its thermal expansion. The short fibers are provided in the form of bundles each of which consists of 50–500 fibers, preferably 100–200 fibers, each fiber having a length of 1–10mm, preferably about 3–5 mm. Where the fibers are formed of a glass material, the diameter is held within a range of about 5–10 microns. The carbon fibers have a diameter of about 3–15 microns, while the $Al_2O_3$ fibers have a diameter of about 1–15 microns.

In one specific example, dimensions d1, d2 and d3 of the instant grinding wheel 10 as indicated in FIG. 1 are 240 mm, 220 mm and 120 mm, respectively, and the radial thickness of the cylindrical wall of the outer abrasive member 14 is 10 mm. The volume of the outer abrasive member 14 is about 21% of the total volume of the inner and outer abrasive members 12, 14. The inclination angle $\theta$ of the front end faces 18, 22 is selected within a range of about 0.2°–1°, and the axial length L of the inner abrasive member 12 is about 48 mm. However, the dimensions and configuration of the grinding wheel 10 are not limited to those indicated above by way of example, but may be suitably changed, depending upon various grinding conditions such as the diameter of a roll to be ground, and the operating posture of the grinding wheel 10.

The assembly of the inner and outer abrasive members 12, 14 is secured to one of the opposite surfaces of a circular backing plate 23, which has a round center bore. This backing plate 23 consists of the abrasive grains such as $Al_2O_3$, SiC, CBN and diamonds, which are bonded together by phenol resin. The backing plate 23 has nuts 28 embedded in the other or outer surface thereof, so that a mounting flange 33 is bolted to the backing plate 23, with bolts 30 screwed to the nuts 28. The mounting flange 33 is fixed to an end of a shaft 32 which is rotatably supported by a suitable bearing device, so that the grinding wheel 10 may be used to grind a roll or rolls as mounted on a rolling stand.

Figure 2:
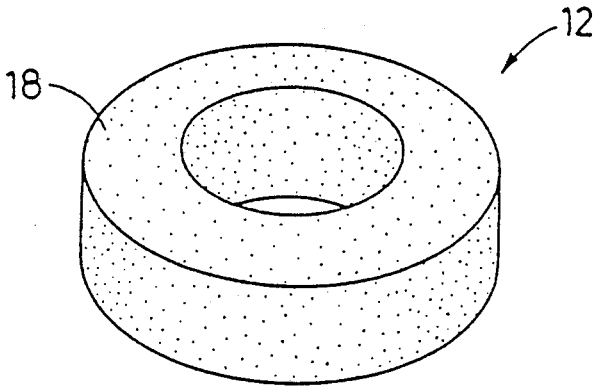
FIG. 2 is a perspective view of an inner abrasive member of the grinding wheel of FIG. 1.

The inner or first abrasive member 12 per se is shown in the perspective view of FIG. 2. To prepare this inner abrasive member 12, a mass of the selected abrasive grains such as $Al_2O_3$, SiC, CBN or diamond and a mass of the selected vitrified bonding agent such as feldspar, pottery stone or refractory clay are mixed together, in a suitable proportion. An intimate powdered mixture of the abrasive grains and the bonding agent, which is obtained by a suitable mixing or stirring method, is press-formed into a cylindrical shape, and the formed shape is fired at a temperature in the neighborhood of 1400° C. The fired cylindrical body is then finished to the desired dimensions. The finishing process includes a chamfering to provide the inclined end face 18, and may include roughing of the outer circumferential surface and the rear end face of the fired body, as needed.

Figure 3:
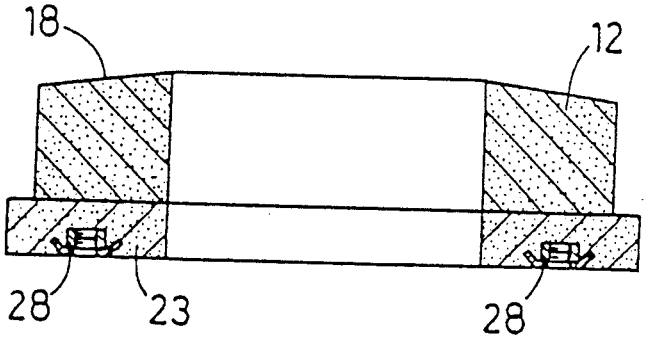
FIG. 3 is an elevational view in axial cross section of the inner abrasive member and a backing plate secured thereto.

The thus prepared inner abrasive member 12 is bonded with an adhesive to the inner surface of the backing plate 23, as illustrated in FIG. 3. An epoxy resin adhesive may be suitably used to bond the abrasive member 12 to the backing plate 23. To prepare the backing plate 23, the selected material such as $Al_2O_3$ or SiC and phenol resin are mixed together into an intimate powdered mixture, in a suitable proportion so as to provide the backing plate 23 with a required value of mechanical strength. The mixture is press-formed into a desired disc-like shape, such that the nuts 28 are embedded in the outer surface of the formed body. The formed body is then fired at about 200° C., and the fired body is finished into the backing plate 23. The finishing process may include roughing of the inner surface to be bonded to the inner and outer abrasive members 12, 14.

Figure 4:
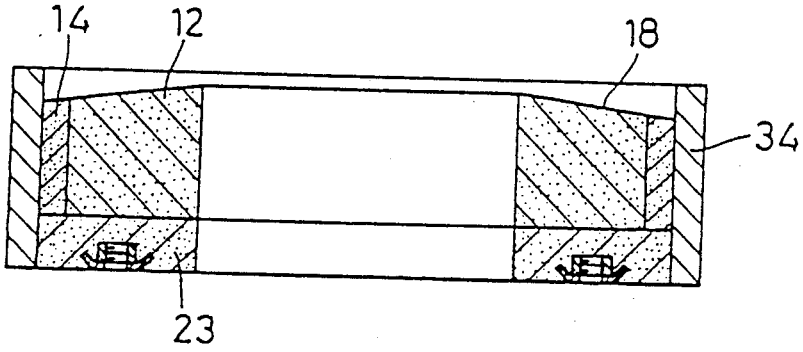
FIG. 4 is an elevational view in axial cross section, showing an outer abrasive member of the grinding wheel, which is formed by filling an annular space between the inner abrasive member and a mold, with a mixture material which includes abrasive grains.

As illustrated in FIG. 4, a cylindrical mold 34 which has an inside diameter substantially equal to the outside diameter of the backing plate 23 is fitted on the outer circumferential surface of the backing plate 23 to which the inner abrasive member 12 has been bonded. In the meantime, there is prepared an intimate mixture which includes, in a suitable proportion, the selected abrasive grains such as $Al_2O_3$, SiC, CBN or diamond and epoxy resin as the bonding agent, and short fibers of glass, carbon, $Al_2O_3$ or other suitable material, if and as needed. The prepared mixture is poured into an annular space formed between the cylindical mold 34 and the inner abrasive member 12, and is left at the room temperature until the epoxy resin is cured for bonding the abrasive grains. Thus, the outer abrasive member 14 is formed as bonded to the inner abrasive member 12 and the backing plate 23.

The assembly of the inner and outer abrasive members 12, 14 and the backing plate 23 is removed from the cylindrical mold 34, and the outer abrasive member 14 is finished. The finishing process includes a chamfering to provide the inclined end face 22. Thus, there is produced the grinding wheel 10 which is the integrally bonded assembly of the three members 12, 14, 23.

The grinding wheel 10 attached to the shaft 32 is used as indicated in FIGS. 5–7. In these figures, reference numeral 40 designates a roll 40 (working roll) which is rotated about a substantially horizontal axis l, on a hot-rolling stand. The grinding wheel 10 is disposed such that an axis "m" of rotation of the wheel 10 is offset by a distance "s" in the vertically downward direction from the axis l of the working roll 40, and such that the rotation axis "m" is inclined with respect to a plane "n" perpendicular to the axis l, by an angle $\phi$ which is almost equal to the inclination angle $\theta$ of the end faces 18, 22 of the abrasive members 12, 14. The grinding wheel 10 is supported by the shaft 32, rotatably about its axis "m", such that the end faces 18, 22 are held in pressed contact with the outer circumferential surface of the roll 40, by suitable pressing means. In this condition, the grinding wheel 10 is rotated counterclockwise as indicated by an arrow in FIG. 5, by the roll 40 when the roll 40 is rotated, as also indicated in FIG. 5. The grinding wheel 10 is reciprocated or oscillated in the axial direction of the roll 40 (in the right and left directions as viewed in FIGS. 5 and 7). For example, the grinding wheel 10 is rotated at the peripheral speed of 400–1000 m/min. Since the rotating directions and speeds of the wheel 10 and the roll 40 are different and since the wheel 10 is reciprocated relative to the roll 40, there arise frictional sliding movements between the end faces 18, 22 of the abrasive members 12, 14 and the outer circumferential surface of the roll 40, whereby the outer circumferential surface of the roll 40 is ground by the end faces 18, 22. Usually, a plurality of the grinding wheels 10 are arranged in a row parallel to the axis of the roll 40, such that the wheels 10 are spaced apart from each other by a suitable distance.

During a grinding operation wherein the grinding wheel 10 is held in pressed frictionally sliding contact with the outer circumferential surface of the working roll 40 in the process of a hot-rolling or cold-rolling operation, the grinding wheel 10 may be subject to a comparatively high degree of impact or shock, due to vibrations of the roll 40 or collision of the wheel 10 with projections on the roughened surface of the roll 40. Further, the frictional sliding movements of the wheel 10 relative to the roll 40 cause a tensile stress and a compressive stress to be exerted to the radially outer and inner portions of the end faces 18, 22, respectively. Therefore, if a grinding wheel consists solely of a vitrified-bond wheel having high heat resistance and high grinding capability but having a comparatively high modulus of elasticity (comparatively low impact resistance), the radially outer portion of the wheel subject to the tensile stress tends to easily chip or crack or be otherwise damaged.

In view of the above drawback encountered in the known grinding wheel, the instant grinding wheel 10 has an integral double-layer abrasive structure consisting of the first or inner abrasive member 12 (vitrified-bond wheel) having excellent grinding capability, and the second or outer abrasive member 14 (resinoid-bond wheel) which has sufficiently low modulus of elasticity and accordingly high shock or impact resistance. Namely, the radially outer portion (outer abrasive member 14) of the grinding wheel 10 has improved shock resistance to withstand the tensile stress indicated above, and is therefore effectively protected against chipping or cracking, while the radially inner portion (inner abrasive member 12) assures efficient grinding of the workpiece.

In particular, it is noted that the outer abrasive member 14 or the resinoid-bond wheel utilizing epoxy resin as the abrasive bonding agent has the modulus of elasticity as low as about 600 kgf/mm$^2$, and the cylindrical wall thickness of as small as 10 mm, which are combined to provide a synergistic effect of protecting the abrasive member 14 against otherwise possible chipping and cracking. Further, the inner abrasive member 12 which has the radial wall thickness of 50 mm enables the grinding wheel 10 to provide a practically sufficient degree of grinding function or capability while assuring improved shock or impact resistance of its radially outer portion (outer abrasive member 14).

Moreover, the inclusion of the short glass, carbon or $Al_2O_3$ fibers uniformly in the outer abrasive member 14 as the reinforcing material further improves the mechanical properties (including the shock resistance) of the radially outer portion of the wheel 10, thereby more effectively avoiding the chipping or other damages of the member 14 due to collision with the irregularities on the surface of the roll 40. Further, the short fibers are effective to increase the toughness and rigidity of the outer abrasive member 14, permitting reduction in the required area of contact with the surface of the roll 40, and protecting the member 14 against deformation due to thermal expansion. In this respect, it is noted that the short fibers exhibit a higher degree of even distribution throughout the mass of the abrasive grains and bonding agent, during preparation of the outer abrasive member 4. Accordingly, the mechanical properties of the abrasive member 14 can be uniformly improved, so that the abrasive member 14 has subtantially no directionality of its properties. The uniformity of the mechanical properties results in further reduction in the chipping or similar damage of the abrasive member 14. For instance, the abrasive member 14 contains bundles of short fibers having a length of 1–10 mm, each bundle consisting of 50–500 fibers. In this case, the short fibers are easily uniformly distributed throughout the abrasive member 14, and the evenness of the properties of the abrasive member 14 is significantly enhanced.

Referring to FIGS. 8–14, other embodiments of the present invention will be described. In these figures, the same reference numerals as used in FIG. 1 will be used to identify the functionally equivalent components, redundant description of which will be omitted, in the interest of brevity and simplification.

In the modified embodiment of FIG. 8 wherein a grinding wheel is indicated generally at 42. This grinding wheel 42 has a circular outer periphery and includes an outer abrasive member in the form of an annular vitrified-bond wheel 44, and an inner abrasive member in the form of an annular resinoid-bond wheel 46 disposed radially inwardly of and integrally with the outer vitrified abrasive member or wheel 44. The inner resinoid abrasive member or wheel 46 has a lower modulus of elasticity than the outer abrasive member 44, because of the use of a resinoid bonding agent, and consequently provides the grinding wheel 42 with improved shock resistance at its radially inner portion. The instant grinding wheel 42 is suitably used such that its axis of rotation "m" is offset from the rotation axis l of the working roll 40, in the vertically upward direction as viewed in FIGS. 5 and 6. While a comparatively large tensile stress tends to be applied to the radially inner portion of the grinding wheel 42 in this case, the inner abrasive member 46 is resistant to such a tensile force. In the present embodiment, the outer vitrified-bond wheel 44 functions as the first abrasive member, while the inner resinoid-bond wheel 46 functions as the second abrasive member. Another second abrasive member having a comparatively low degree of modulus of elasticity may be provided radially outwardly of the first abrasive member 44.

Figure 9:
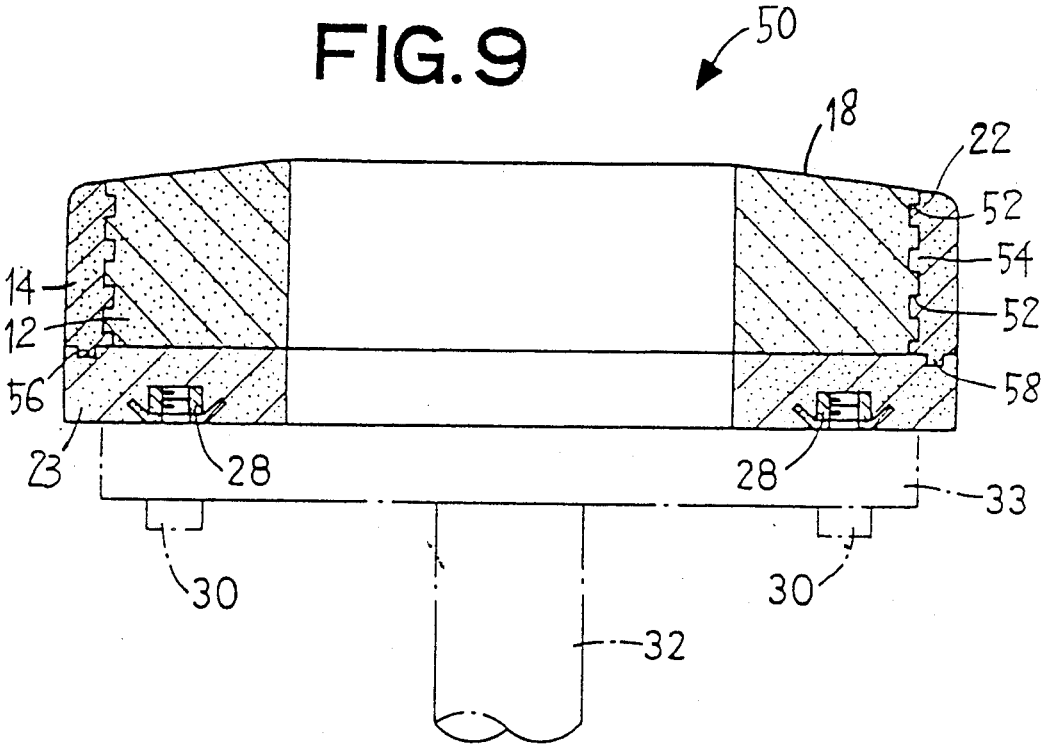

A grinding wheel 50 according to a further embodiment of the present invention shown in FIG. 9 is different from the grinding wheel 10 of the first embodiment of FIG. 1, in that the outer and inner circumferential surfaces of the inner and outer abrasive members 12, 14, which constitute a boundary or interface of the two abrasive members 12, 14, are formed with a plurality of annular grooves 52 and a plurality of annular projections 54 which engage each other, while at the same time the interface surfaces of the backing plate 23 and the outer abrasive member 14 are formed with an annular groove 56 and an annular projection 58 which engage each other. Described more specifically, the annular grooves 52 are formed in the outer circumferential surface of the inner abrasive member 12 such that the grooves 52 are spaced from each other in the axial direction of the grinding wheel 10. The grooves 52 have a rectangular cross-sectional shape (as viewed in FIG. 9), and a width of about 5 mm and a depth of about 1–2 mm. On the other hand, the annular projections 54 are formed in the inner circumferential surface of the outer abrasive member 14, so that the projections 54 may engage the annular grooves 52. The annular groove 56 is formed in a radially outer portion of the backing plate 23 to which the outer abrasive member 14 is bonded, while the annular projection 58 is formed in the corresponding portion of the bonding surface of the outer abrasive member 14, so that the groove and projection 56, 58 engage each other.

In the grinding wheel 50 constructed as described above, the outer abrasive member 14 has considerably increased areas of the interface surfaces which contact the corresponding surfaces of the inner abrasive member 12 and the backing plate 23, in the presence of the annular projections 54, 58 which engage the corresponding annular grooves 52, 56. The strength of bonding of the outer abrasive member 14 to the inner abrasive member 12 and the backing plate 23 is accordingly increased. Further, the engagement between the annular grooves 52 and the annular projections 54 prevents a relative displacement of the inner and outer abrasive members 12, 14 in the axial direction of the grinding wheel 50. The increased bonding strength and the prevention of the relative axial displacement cooperate to effectively minimize a possibility of separation of the inner and outer abrasive members 12, 14, which may occur for any of the following causes: difference in the amount of elastic deformation between the two abrasive members 12, 14 upon pressed contact with the roll 40; difference in the thermal expansion coefficient between the abrasive members; vibrations of the roll 40 during a rolling operation on the rolling stand; and collision of the abrasive members with the outer circumferential surface of the roll 40. Even if the outer abrasive member 14 was separated to some extent for some reason or other, the outer abrasive member 14 is prevented from being moved in the axial direction toward the end face 22. Thus, the instant grinding wheel 50 assures safety of operation. Further, since the annular grooves 52 and projections 54 are provided over the axial end portions of the abrasive members 12, 14 remote from the end faces 18, 22, the above-indicated advantages may be offered until the working surface (end faces 18, 22) of the wheel 50 is worn to an intolerable extent during use.

Figure 10:
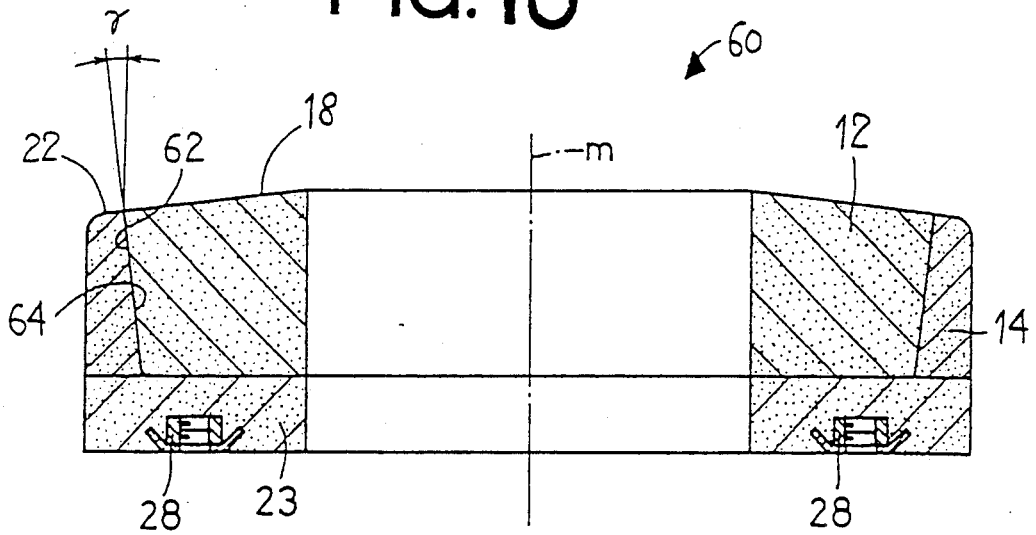

Reference is now made to the embodiment of FIG. 10, wherein the annular inner and outer abrasive members 12, 14 of a grinding wheel 60 have tapered boundary or bonded surfaces, i.e., complementally tapered outer and inner circumferential surfaces 62, 64, respectively, such that the diameters of the circumferential surfaces 62, 64 increase in the axial direction toward the end faces 18 22. Namely, the surfaces 62 64 are inclined at an angle $\gamma$ with respect to a cylinder whose axis is parallel to the rotation axis "m" of the grinding wheel 60. In the instant grinding wheel 60, too, an axial displacement of the outer abrasive member 14 relative to the inner abrasive member 12 in the axial direction toward the end face 22 is prevented by the engagement between the tapered outer and inner circumferential surfaces 62, 64, whereby the separation of the two abrasive members 12, 14 and the movement of the outer abrasive member 14 in the above-indicated axial direction are effectively prevented. Moreover, the present embodiment using the tapered surfaces 62, 64 eliminates a complicated machining operation or a mold to form the annular grooves 52 as provided in the grinding wheel 50 of the preceding embodiment. Accordingly, the cost of manufacture of the grinding wheel 60 is reduced. However, the inclination angle $\gamma$ of the tapered surfaces 62, 64 should not be excessive, in order to avoid a sudden decrease in the area of the inclined working end face 18 due to wear of the wheel 60, which results in a sudden decrease in the grinding capacity of the wheel 60. For avoiding the separation or removal of the outer abrasive member 14 while assuring sufficient grinding capacity of the wheel 60, the inclination angle $\gamma$ of the tapered surfaces 62, 64 should be held generally within a range of 0.5°-20°, preferably within a range of 1°-3°. In other words, the taper angle of the tapered surfaces 62, 64 (according to JIS: B0154) should be held generally within a range of 1°-40°, and preferably within a range of 2°-6°.

Figure 11:
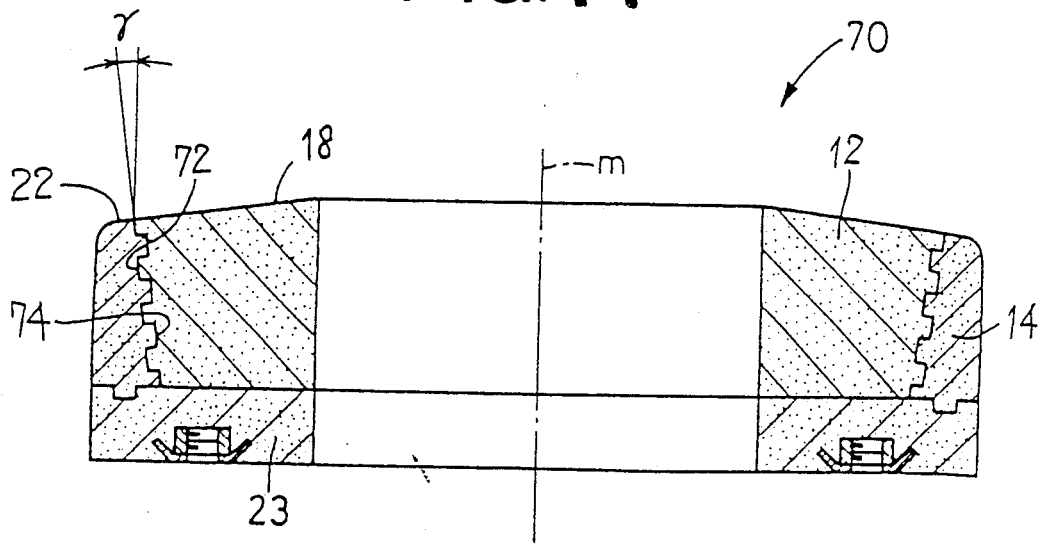

Referring next to FIG. 11 showing a grinding wheel 70 according to a further embodiment of the invention, the inner and outer abrasive members 12, 14 have outer and inner circumferential surfaces 72, 74, which are tapered like the tapered surfaces 62, 64 of the grinding wheel 60 of FIG. 10, but are formed with annular grooves and projections similar to the grooves and projections 52, 54 provide in the grinding wheel 50 of FIG. 9. This embodiment provides the same advantages as offered by the embodiment of FIG. 9.

Figure 12:
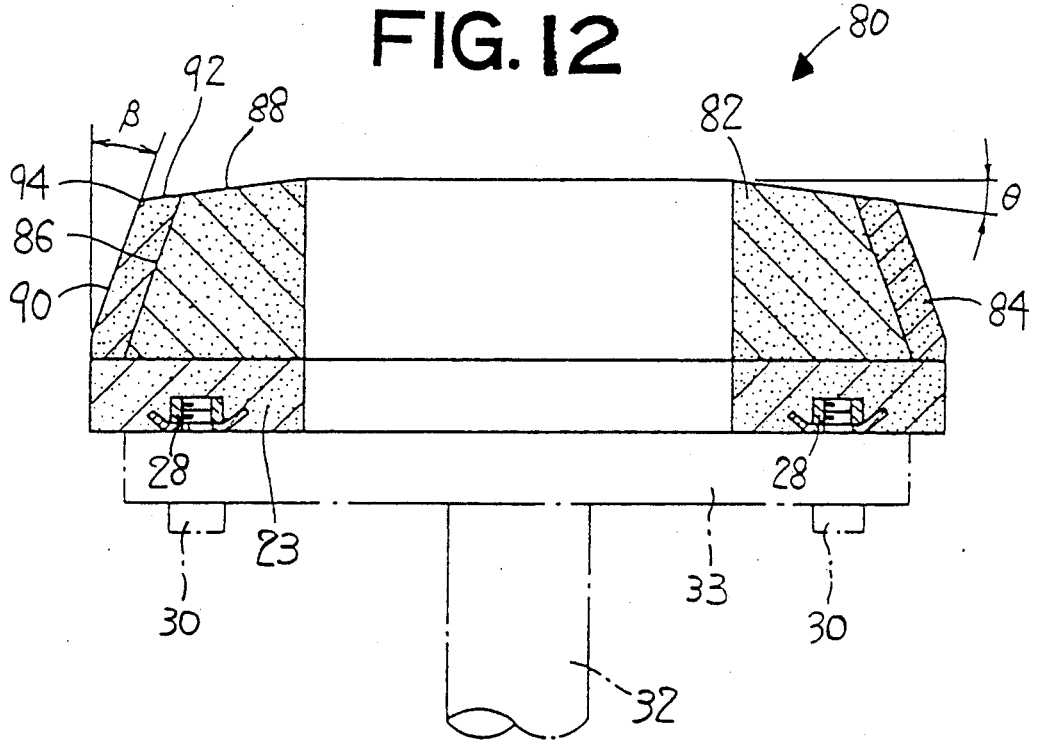

A grinding wheel 80 shown in FIG. 12 includes the first abrasive member in the form of an annular inner abrasive member 82, the second abrasive member in the form of an annular outer abrasive member 84 bonding to an outer circumferential surface 86 of the inner abrasive member 82, and the backing plate 23 bonded to the rear end faces of the inner and outer abrasive members 82, 84. Like the vitrified inner abrasive member 12 of the grinding wheel 10 of the first embodiment, the inner abrasive member 82 consists of a vitrified-bond wheel whose modulus of elasticity is held within a range of 2000-7000 kgf/mm$^2$, preferably in the neighborhood of 5000 kgf/mm$^2$. Further, the outer abrasive member 84 consists of a resinoid-bond wheel which contains evenly distributed short fibers such as short glass fibers, and whose moduls of elasticity is held within a range of 100-1000 kgf/mm$^2$, preferably in the neighborhood of 600 kgf/mm$^2$, by adjusting the proportion of the bonding agent of epoxy resin and the abrasive grains, like the outer abrasive member 14 of the grinding wheel 10.

The outer circumferential surface 86 of the inner abrasive member 82 is inclined at an angle 8 with respect to a cylinder whose axis is parallel to the axis of rotation of the wheel 80, so that the diameter of the surface 86 decreases in the axial direction toward a working annular end face 88 of the abrasive 82. The outer abrasive member 84 bonded to this tapered outer circumferential surface 86 of the inner abrasive member 82 has a constant radial wall thickness and a tapered outer circumferential surface 90 which is inclined at the same angle $\beta$ as the inner abrasive 82. Stated differently, the first or inner abrasive member 82 has an outside diameter (86) which decreases in the direction toward the end face 88, so that the total radial wall thickness of the grinding wheel 80 decreases in the axial direction toward the end faces 82, 92 of the inner and outer abrasive members 82. 84. In this respect, the present grinding wheel 80 is different from the grinding wheels 10, 42, 50, 60 and 70 of the preceding embodiments of FIGS. 1, 8, 9, 10 and 11.

In the present grinding wheel 90, an angle of an edge 94 of the outer abrasive member 84 adjacent to the working front end face 92 is as large as $(\theta+\beta+90)°$. This comparatively large angle of the edge 94 is an additional factor contributing to an increase in the shock or impact resistance of the edge 94, that is, a factor in addition to the use of a resinoid bonding agent to give the outer abrasive member 84 a comparatively low modulus of elasticity, and the use of glass or other short fibers contained in the mass of the abrasive member 84.

While the impact resistance of the edge 94 increases with an increase in the angle $\beta$ of the outer circumferetial surfaces 86, 90, the increase in the angle $\beta$ results in a decrease in the area of the end face 88, and consequently resulting in a decrease in the grinding capacity of the grinding wheel 80, and a sudden decrease in the area of the end face 88 (sudden reduction in the grinding capacity) as the end face 88 is worn. For assuring a practically optimum compromise between the impact resistance of the edge 94 and the grinding capacity of the grinding wheel 80, the angle $\beta$ should not exceed 30°, usually about 10°. That is, the taper angle (according to JIS: B0154) of the surfaces 86, 90 should be 60° or smaller, and usually about 20°. Further, the end faces 88, 92 are tapered such that the axial distance or thickness of the grinding wheel 80 decreases in the radial outward direction. The inclination angle $\theta$ of the end faces 88, 92 is selected within a range of 0.2°-1° with respect to a plane perpendicular to the rotation axis of the wheel 80, depending upon the operating posture of the wheel 80.

Figure 13:
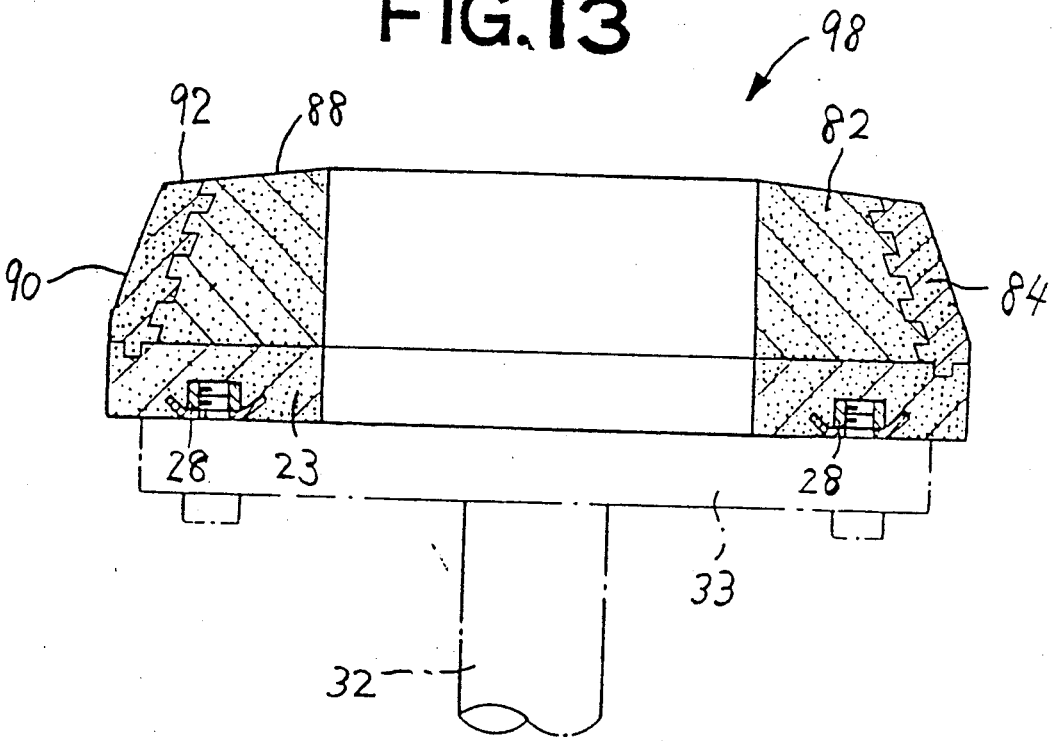

A grinding wheel 98 shown in FIG. 13 is identical with the grinding wheel 80 described above, except that the bonded outer and inner circumferential surfaces of the inner and outer abrasive members 82, 84 have annular grooves and projections, while the bonded surfaces of the outer abrasive member 84 and the backing plate 23 have an annular projection and an annular groove. According to this arrangement, the outer abrasive member 84 has increased strength of bonding with respect to the inner abrasive member 82 and the backing plate 23, and is suitably prevented from being separated or removed from the abrasive member 82 and backing plate 23, or being displaced in the axial and radial directions relative to these members 82, 23.

Figure 14:
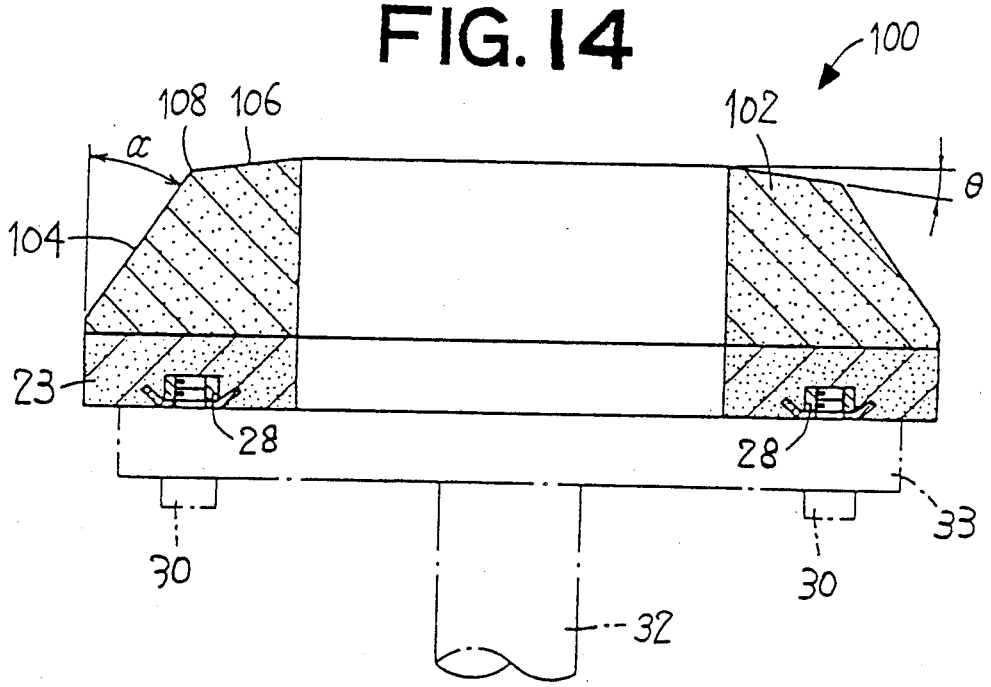
Figure 15:
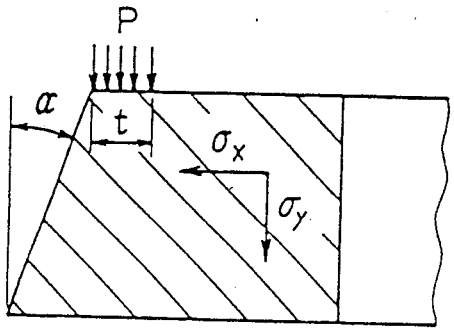
FIG. 15 is an explanatory view indicating dimensions, an angle of a grinding wheel, and directions of forces on the wheel, which aid in understanding an amount of deformation of the wheel and a tensile stress on the wheel.

Referring next to FIG. 14, there is shown a further embodiment of the present invention in the form of a grinding wheel 100 which includes an annular abrasive member 102 having a generally frusto-conical shape, and the backing plate 23. Like the inner abrasive member 12 of the grinding wheel 10 of the first embodiment, the abrasive member 102 consists of a vitrified-bond wheel whose modulus of elasticity is selected within a range of 2000-7000 kgf/mm$^2$, preferably in the neighborhood of 5000 kgf/mm$^2$. The abrasive member 102 has a tapered outer circumferential surface 104 which is inclined at an angle $\alpha$ with respect to a cylinder whose axis is parallel to the rotation axis of the wheel 100, such that the surface 104 has an outside diameter which decreases in the axial direction toward a working front end face 106, so that the radial wall thickness of the grinding wheel 100 decreases in the same axial direction. Further, the end face 106 is inclined at an angle $\theta$ with respect to the plane perpendicular to the axis of the wheel 100. The inclination angle $\alpha$ of the surface 104 is selected within a range of 25°-40° (taper angle of 50°-80° according to JIS: B0154), preferably about 30°

(taper angle of about 60°). The inclination angle $\theta$ of the end face 106 is selected within a range of 0.2°-1°, depending upon the operating posture of the wheel 100.

Like the grinding wheel 10, the instant grinding wheel 100 is used in a manner as illustrated in FIGS. 5-7. Although the wheel 100 with the abrasive member consisting of the vitrified-bond wheel 102 does not have a resinoid abrasive member, the wheel 100 has a practically sufficient level of impact resistance, because of a considerably large angle of an edge 108 at the radially outer end of the end face 106, i.e., $(\theta+\alpha+90)°$ which is as large as at least 120° where the angle is 30°, for example. Accordingly, the edge 108 is suitably protected against chipping, cracking or similar damage due to vibrations of the roll 40 or due to collision of the wheel 100 with the more or less raised and recessed outer circumferential surface of the roll 40. Yet, the wheel 100 has excellent grinding capability owing to the sole vitrified-bond wheel 102.

Referring to FIGS. 15-19, a comparative analysis of a grinding wheel according to the invention and a known grinding wheel will be described. In the analysis, amounts of deformation of the wheels and tensile stresses $\sigma x$ (kgf/mm$^2$) exerted on the surface portion of the wheels are considered under the following conditions:

| | |
|---|---|
| Inclination angle $\alpha$ | 0-40° |
| Wheel contact pressure P against roll | 200 kgf |
| Radial distance t of wheel contact (from the outer edge of the working end face) | 1 mm/5 mm/10 mm |
| Modulus of elasticity | 5800 kgf/mm$^2$ |

Figure 16:
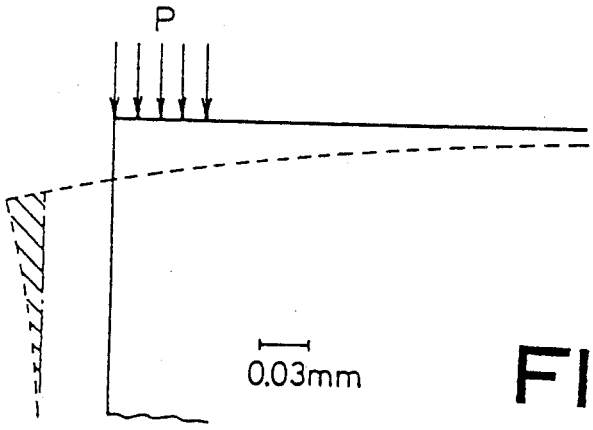
FIG. 16 is a view explaining an amount of deformation of a known grinding wheel.
Figure 17:
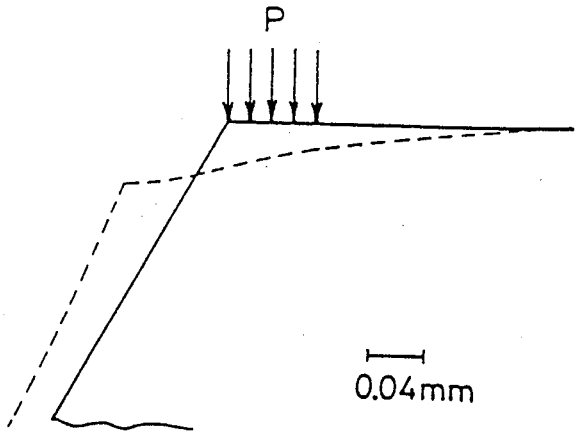
FIG. 17 is a view explaining the amount of deformation of the grinding wheel according to the invention.

Dashed line in FIG. 16 indicates the profile of the known grinding wheel (inclination angle $\alpha=0°$) which is deformed with the wheel contact pressure P of 200 kgf over the contact area t of 1.0 mm. As illustrated in FIG. 16, the deformation of the known grinding wheel takes place with its outer periphery displaced radially outwardly by a considerable amount, tending to cause chipping or cracking of the edge portion as indicated by hatched lines in the figure. Dashed line in FIG. 17 indicates the profile of the grinding wheel (inclination angle $\alpha=30°$) according to the present invention which is deformed under the same conditions as described above. As shown in FIG. 17, the amount of deformation of the instant grinding wheel is smaller than that of the known wheel, whereby the possibility of chipping or cracking of the outer edge portion is reduced.

Figure 18:
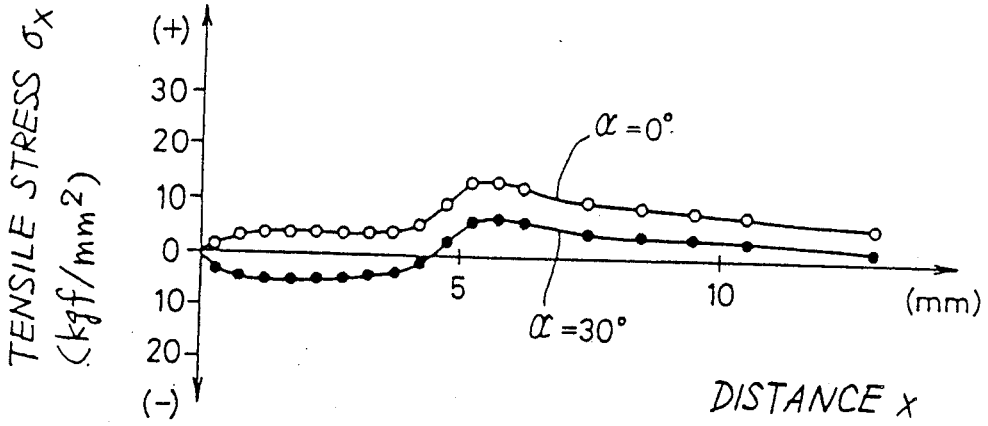
FIG. 18 is a graph showing amounts of tensile stresses on the known and present grinding wheels, in comparison.

The graph of FIG. 18 indicates values of the tensile stress $\sigma x$ calculated at different radial positions on the surface portion of the end face of the instant and known wheels having the inclination angles of 30° and 0°, when the wheel is pressed over the radial contact distance t of 5 mm (from the outer edge) with the contact pressure P of 200 kgf. The tensile stress is taken along the ordinate of the graph, while a radial distance x is taken along the abscissa. The radial distance x is a distance as measured from the outer edge of the wheel, at which the values of the tensile stress are measured, such that the tensile stress at the outer edge is zero. The values of the tensile stress $\sigma x$ are positive (+) when the tensile stress acts in the radially outward direction of the wheel (in the left direction as viewed in FIG. 15). It will be understood from the graph of FIG. 18 that the tensile stress values of the instant wheel (inclination angle $\alpha$ of 30°) are generally smaller than those of the known wheel, and are negative (−) near the outer edge of the wheel, i.e., over the area t (radial wheel contact distance t of 5 mm) in which the working end face of the wheel is held in pressed contact with the roll. Namely, a compressive stress is exerted to the outer portion of the wheel. In this respect, it is noted that the chipping or cracking of a grinding wheel is generally caused by a stensile stress. According to the present invention wherein the outer edge portion of the wheel is subjected to a compressive force, the chipping or other damage will not easily occur at the edge portion.

Figure 19:
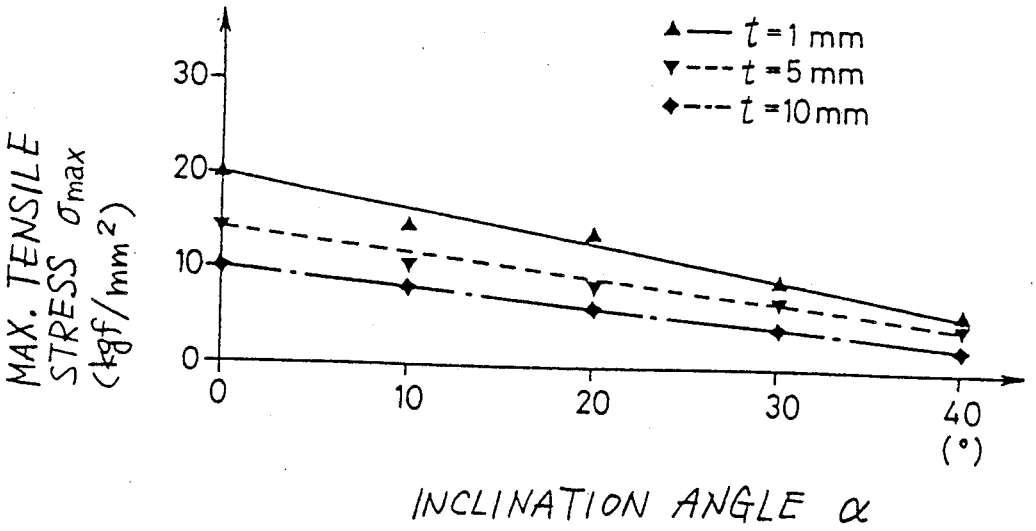
FIG. 19 is a graph showing relationships between the taper angle of the outer circumferential surface of the grinding wheel, and a maximum tensile stress exerted to the surface portion of the end face of the wheel.

Further, the graph of FIG. 19 indicates the maximum values $\sigma$max of the tensile stress $\sigma x$ at the surface of the end face of the grinding wheels whose inclination angles $\alpha$ are 0°, 10°, 20°, 30° and 40°, with the contact pressure P of 200 kgf, and with the radial contact distance t of the wheels being set to 1 mm, 5 mm and 10 mm. As is apparent from the graph, the maximum tensile stress $\sigma$max decreases with an increase in the inclination angle $\alpha$. That is, the chipping or other damage of the wheel is reduced as the inclination angle increases.

Six specimens according to the grinding wheel 100 of FIG. 14 were prepared, and subjected to a test wherein the specimen wheels 100 were used to grind the outer surface of the roll 40, as indicated in FIGS. 5-7, with the wheels 100 reciprocated in the axial direction of the roll 40. The abrasive member 102 of each specimen wheel 100 had an inside diameter of 80 mm, a maximum outside diameter (at the lower end in FIG. 14) of 240 mm, an axial distance of 48 mm, and inclination angle $\theta$ of about 0.7°. The six specimens had respective inclination angles $\alpha$ of 0°, 10°, 20°, 25°, 30° and 40°. The outer surface of the roll 40 had raised portions each having a width of 10 mm and a height of 0.5 mm. The edges 108 of the specimen wheels 100 were observed for any damage, and the observed condition of the edges 108 are indicated in Table 1 below. The test was conducted under the following conditions:

TABLE 1

| Test Conditions | |
|---|---|
| Wheel offset distance "s" | 20 mm |
| Inclination angle $\phi$ (FIG. 7) | 0.5° |
| Diameter of roll 40 | 600 mm |
| Peripheral speed of roll 40 | 600 m/min. |
| Wheel contact pressure P | 200 kgf |
| Wheel reciprocating speed | 60 mm/sec. |
| Grinding time | 5 min. × 3 passes |

| | Inclination Angle | | | | | |
|---|---|---|---|---|---|---|
| SPECIMENS | 0° | 10° | 20° | 25° | 30° | 40° |
| EDGE CONDITION | Poor | Poor | Poor | Good | Better | Better |

The "Poor" condition in the table above means the occurrence of chipping or similar damage of the edge 108 to an extent that prevents the wheel 100 from being re-used, while "Good" condition means a slight degree of chipping or similar damage of the edge 108. The "Better" condition means substantially no chipping or similar damage of the edge 108, and that the wheel 100 may be re-used. It follows from the above table that the grinding wheel 100 consisting of the vitrified-bond wheel 102 provides a practically sufficient degree of impact resistance, where the inclination angle $\alpha$ is 25° or more, preferably at least 30°. However, as the inclination angle $\alpha$ increases, the area of the end face 106 of the wheel 100 decreases, and the rate of decrease in the same area due to wear of the wheel 100 increases. In view of this fact, it is desirable that the inclination angle $\alpha$ be as small as possible, yet large enough to provide the wheel 100 with a practically required value of impact resistance. That is, the inclination angle $\alpha$ is usually selected within a range between 25° and 40°, and is preferably set in the neighborhood of 30°.

In the case of the grinding wheels 80 and 90 of FIGS. 12 and 13 described above wherein the resinoid abrasive member having comparatively low modulus of elasticity is provided outside the inner vitrified abrasive member, a sufficiently high value of impact resistance is given even where the inclination angle $\beta$ is smaller than the above-indicated inclination angle $\alpha$.

Figure 20:
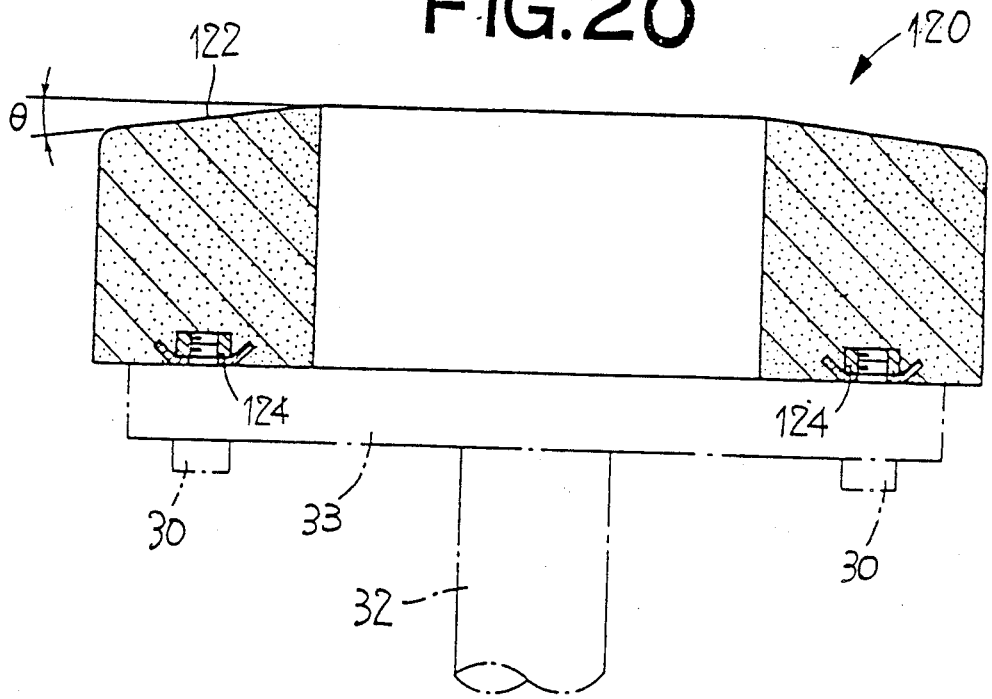
FIGS. 20 and 21 are elevational views in axial cross section of further embodiments of the present invention.

A still further modified embodiment of the invention is illustrated in FIG. 20, wherein an annular grinding wheel 120 has a generally cylindrical shape with a working front end face 122, which is inclined at an angle $\theta$ with respect to a plane perpendicular to the axis of the wheel, such that the axial distance of the wheel decreases in the radially outward direction. The tapered end face 122 is rounded at its radially outer edge portion, to an arc radius of about 5 mm. Like the outer abrasive member 14 of the grinding wheel 10, this grinding wheel 120 consists of a resinoid-bond wheel wherein the selected abrasive grains such as $Al_2O_3$, SiC, CBN and diamond are bonded together with the bonding agent consisting of an epoxy resin. The resinoid-bond wheel 120 contains evenly distributed bundles of short glass fibers having diameters of 5–10 mm. Each bundle consists of 50–500 fibers, preferably 100–200 fibers, and the length of the fibers ranges from 1 mm to 10 mm, preferably falls within a range of 3–5 mm. The wheel 120 has nuts 124 embedded in its rear end face, and is directly secured to the mounting flange 33, with the bolts 30 screwed to the nuts 124. The flange 33 is fixed to one end of the shaft 32, as described above with respect to the first embodiment.

This grinding wheel 120 is used in the manner as illustrated in FIGS. 5–7. In the presence of the short glass fibers contained evenly throughout the mass of the wheel 120, the wheel is provided with improved mechanical properties, whereby the wheel 120 is protected against chipping or cracking due to the vibrations of the roll 40, collision of the wheel with raised portions of the outer surface of the roll. Further, the glass fibers reduce the amount of deformation of the wheel 120 due to thermal expansion, and give the wheel increased toughness and rigidity, which permit reduction in the required area of contact of the wheel with the roll 40, or assure higher grinding efficiency.

As described above, the short fibers exhibit a higher degree of even distribution throughout the mass of the abrasive grains and bonding agent, during preparation of the grinding wheel 120. Accordingly, the mechanical properties of the wheel 120 can be uniformly improved so that the wheel 120 has substantially no directionality of its properties. The uniformity of the mechanical properties results in further reduction in the chipping or similar damage of the grinding wheel 20. For instance, the wheel 120 contains bundles of glass fibers having a length of 1–10 mm, each bundle consisting of 50–500 fibers. In this case, the short fibers are easily uniformly distributed throughout the wheel 120, and the evenness of the properties of the wheel 120 is significantly enhanced.

Since the grinding wheel 120 is a resinoid-bond wheel using the epoxy resin as the bonding agent, the wheel 120 has significantly higher impact resistance than that of a vitrified-bond wheel which uses inorganic bonding agents such as feldspar, pottery stone and refractory clay. Therefore, the grinding wheel 120 may absorb the received impact or shock due to the vibrations of the roll 40, and permits improved consistency of the surface finish of the roll 40 as ground by the wheel 120.

Figure 21:
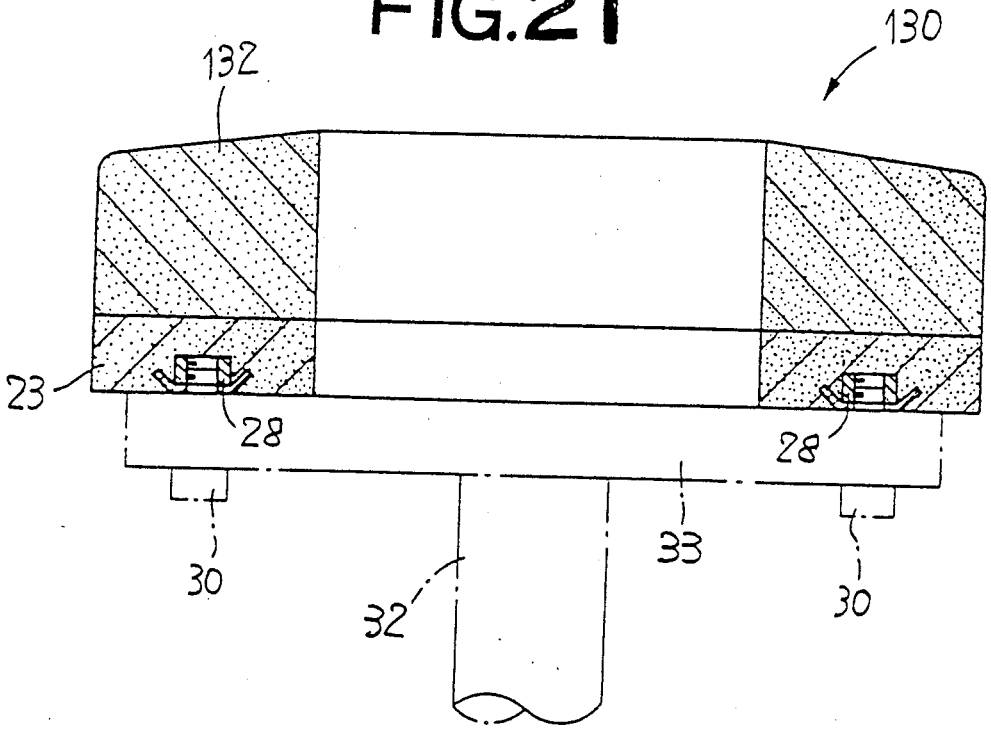

Although the grinding wheel 120 is directly secured to the mounting flange 33 with the nuts 124 and bolts 30, the wheel 120 may be secured to a backing plate as used in the grinding wheel 10. Namely, the embodiment of FIG. 20 may be modified into a grinding wheel 130 shown in FIG. 21, wherein an an annular abrasive member 132 identical with the grinding wheel 120 is secured to the backing plate 23, which in turn is bolted to the mounting flange 30.

While the present invention has been described in its presently preferred embodiments, by reference to the accompanying drawings, it is to be understood that the invention may be otherwise embodied.

For example, the vitrified-bond wheel used as the first abrasive member in the form of the inner abrasive member 12, 82 or outer abrasive member 44, or as the single abrasive member 102 may be replaced by a resinoid-bond wheel such as GC220J8B, WA220J8B (both according to the Japanese Industrial Standard) or CBNC170N100B (CONCENTRATION 100), whose modulus of elasticity is comparatively high. Further, the vitrified first abrasive member or abrasive member 102 may be replaced by a metal-bond wheel which uses metallic bonds, or replaced by such a resinoid or metal-bond wheel which contains evenly distributed short fibers such as glass, carbon or $Al_2O_3$ fibers, as a material for improving the impact resistance of the first abrasive member.

While the second abrasive member in the form of the outer abrasive member 14, 84, and the wheel 120 or single abrasive member 132 use epoxy resin as the resinoid bond, these resinoid abrasive members and wheel may be replaced by a resinoid-bond wheel using other resinoid bonding agents such as phenol resins and polyvinyl alcohol resins, or by a rubber-bond wheel using natural or synthetic rubber materials. Where the phenol resins are used as the bonding agent, it is desirable that a formed mass of the abrasive grains and the phenol resins be fired within a mold, in order to prevent otherwise possible thermal expansion of the fired body.

In the embodiments of FIGS. 1, 8, 9, 10, 11, 12, 13, 14 and 21, the grinding wheels 10, 42, 50, 60, 70, 80, 98, 100, 130 are secured to the respective backing plates 23. However, the backing plates 23 may be omitted, as in the embodiment of FIG. 20 wherein the grinding wheel 20 is directly secured to the mounting flange 33. In this case, the inner abrasive members 12, 82, outer abrasive member 44 and abrasive member 102, 132 have the nuts embedded therein for anchoring to the mounting flange 33, and it is desirable that the outer abrasive members 14, 84 of the grinding wheels 10, 80 and the inner abrasive member 46 of the grinding wheel 42 be held in abutting contact with the mounting flange 33. Further, the backing plate 23 may be replaced by a disc-like member which does not have a round center hole, or may be formed of a material other than that described above.

In the illustrated embodiment of FIGS. 5–7 of the manner in which the grinding wheel 10 is used for grinding the roll 40 by way of example, the wheel 10 is negatively rotated by the rotation of the roll 40, with the end faces 18, 22 being held in pressed contact with the outer circumferential surface of the roll 40, such that the axis "m" of the wheel 10 is offset relative to the rotation axis l of the roll 40, and inclined with respect to the plane "n". However, the manner of grinding by the grinding wheel according to the instant invention may be suitably changed, in various aspects such as the operating posture of the wheel. A suitable drive motor or a braking device may be connected to the grinding wheel, so that the wheel is positively rotated or stopped. It will be understood that necessary modifications or adjustments of the grinding wheel may be made in its dimensions and configuration, depending upon the specific manner in which the wheel is operated.

While the grinding wheel is used to grind the working roll 40 as installed on a hot-rolling mill stand in the illustrated embodiment of FIGS. 5–7, it is to be understood that the grinding wheel constructed according to the invention may be equally suitably used to grind other rolls such as back-up rolls for the working roll 40, and rolls provided on cold-rolling mill stands and other types of machines and equipments.

It is noted that the method of preparing the grinding wheel 10 of FIG. 1 has been described above by reference to FIGS. 2–4, for the illustrative purpose only. It will be obvious that the grinding wheel according to the invention may be produced by other methods For example, the outer abrasive member 14 may be formed by bonding with an adhesive a plurality of arcuate abrasive segments to the outer surface of the inner abrasive member 12, such that the arcuate abrasive segments form the outer abrasive member 14. This modification may apply to the outer abrasive members of the other embodiments which include the first and second (inner and outer, or outer and inner) abrasive members. Further, the outer abrasive members 14, 84 of the grinding wheels 60, 80, which have a tapered inner circumferential surface, may be first formed separately from the inner abrasive members 12, 82, and are subsequently fitted on the outer circumferential surface of the respective inner abrasive members 12, 84, with a suitable adhesive such as epoxy resin applied to bond the inner and outer circumferential surfaces of the outer and inner abrasive members.

The dimensions and cross-sectional shapes of the annular grooves 52, 56 of the grinding wheel 50 may be suitably modified For instance, the width of the grooves 52, 56 at their opening is smaller than that at their bottom. Further, the annular grooves and projections 52, 54 having a rectangular cross-sectional shape may be replaced by corrugated or undulated outer and inner circumferential surfaces of the inner and outer abrasive members 18, 22. The same modification may apply to the grinding wheels 70 and 98.

While the outer and inner circumferential surfaces 62, 64 of the grinding wheel 60 are tapered over the entire axial length thereof, the front end portions of the surfaces adjacent to the working end faces 18, 22 may be formed as cylindrical surfaces whose axis is parallel to the axis "m" of the wheel In the grinding wheel 42, the outer first abrasive member 44 and the inner second abrasive member 46 have the cylindrical bonded inner and outer circumferential surfaces. To prevent displacement of the second abrasive member 46 relative to the first abrasive member 44 in the direction away from the backing plate 23, the two abrasive members 44, 46 may have tapered bonded surfaces which are formed such that the inside and outside diameters of the outer and inner abrasive members 44, 46 increase in the axial direction toward the backing plate 23.

In the grinding wheels 80, 98, 100, the outer circumferential surfaces 90, 104 are tapered. However, the inner circumferential surfaces of the inner abrasive member 82 and abrasive member 102 may be tapered such that the radial wall thickness of the members 82, 102 decreases, i.e., the inside diameter of the inner surfaces increases in the axial direction toward the end faces 88, 106. This configuration is desirable where the radially inner portion of the grinding wheels 80, 98, 100 is more likely to be damaged during a grinding operation, under certain grinding conditions including the operating posture of the wheels. In this case, it is desirable that the second abrasive member 84 of the grinding wheels 80, 98 be positioned radially inwardly of the first abrasive member 82, and have a tapered inner circumferential surface whose inside diameter increases in the axial direction toward the end face 92. If necessary, both of the inner and outer circumferential surfaces of the grinding wheels 80, 98, 100 may be tapered such that the radial wall thickness of the wheels decreases in the axial direction toward the working end face.

In the embodiments of FIGS. 12 and 13, the outer abrasive member 84 has the tapered inner and outer surfaces which define a constant radial wall thickness over the entire axial length. However, the inner surface of the outer abrasive member 84, and the corresponding outer surface 86 of the inner abrasive member 82 may both be formed as cylindrical surfaces whose axis is parallel to the axis of the wheels 80, 98.

While the grinding wheel 120 and the abrasive member 132 of the grinding wheel 130 contains short glass fibers, they may contain other short fibers such as carbon fibers or $Al_2O_3$ fibers. Certainly, the diameter and length of the fibers, and the number of each bundle of the fibers may be suitably changed The above modifications may apply to the other grinding wheels which use short glass fibers.

It will be understood that the present invention may be embodied with various other changes, modifications and improvements, which may occur to those skilled in the art, without departing from the spirit and scope of the invention defined in the following claims.

What is claimed is:

1. A grinding wheel having a circular outer periphery, and a working front end face for grinding a roll as installed in place for operation, such that the front end face is held in pressed frictionally sliding contact with an outer circumferential surface of the roll, comprising:

a first abrasive member having an annular shape and consisting of one of a vitrified-bond wheel, a resinoid-bond wheel and a metal-bond wheel; and at least one second abrasive member having an annular shape, formed integrally with said first abrasive member, and disposed on corresponding one of radially outward and inward sides of said first abrasive member, each of said at least one second abrasive member comprising a mass of abrasive grains, and a bonding agent for bonding together said abrasive grains, said bonding agent of said each second abrasive member being different from a bonding agent for bonding together abrasive grains of said first abrasive member, said each second abrasive member having a lower modulus of elasticity than said first abrasive member, said each second abrasive member consisting of one of a resinoid-bond wheel containing one of epoxy resin, phenol resin and polyvinyl alcohol resin as the bonding agent, and a rubber-bond wheel containing synthetic or artificial rubber as the bonding agent.

2. A grinding wheel according to claim 1, wherein a modulus of elasticity of said first abrasive member is within a range of 2000–7000 kgf/mm$^2$, while said modulus of elasticity of said each second abrasive member is within a range of 100–1000 kgf/mm$^2$.

3. A grinding wheel according to claim 1, wherein the abrasive grains of said first and second abrasive members consist of at least one of $Al_2O_3$, SiC, CBN and diamond.

4. A grinding wheel according to claim 1, wherein said at least one second abrasive member consists of a single second abrasive member which is bonded to an outer circumferential surface of said first abrasive member, a volume of said single second abrasive being within a range of 5–50% of a total volume of said first abrasive member and said single second abrasive member.

5. A grinding wheel according to claim 1, wherein said each second abrasive member contains evenly distributed short fibers which are selected from the group consisting of glass fibers, carbon fibers and $Al_2O_3$ fibers.

6. A grinding wheel according to claim 5, wherein said short fibers consist of bundles of fibers each of said bundles consisting of a plurality of fibers having a length of 1–10 mm.

7. A grinding wheel according to claim 1, wherein said first abrasive member and said each second abrasive member have bonded circumferential surfaces having recessed and raised portions which engage each other.

8. A grinding wheel according to claim 1, wherein said at least one second abrasive member consists of a single second abrasive member disposed radially outwardly of said first abrasive member, and said first abrasive member and said single second abrasive member have bonded circumferential surfaces which are tapered such that diameters of the tapered bonded circumferential surfaces increase in an axial direction of the wheel toward said front end face.

9. A grinding wheel according to claim 8, wherein an angle of taper of said tapered bonded circumferential surfaces of said first abrasive member and said single second abrasive member is within a range of 1°–40°.

10. A grinding wheel according to claim 8, wherein said tapered bonded circumferential surfaces have recessed and raised portions which engage each other.

11. A grinding wheel according to claim 1, wherein at least one of inner and outer circumferential surfaces of at least one of said at least one second abrasive member which is not bonded to said first abrasive member is tapered such that a total radial wall thickness of said first abrasive member and said at least one second abrasive member decreases in an axial direction of the wheel toward said front end face.

12. A grinding wheel according to claim 11 wherein an angle of taper of said at least one circumferential surface is 60° or smaller.

13. A grinding wheel according to claim 11, wherein said first abrasive member and said each second abrasive member have bonded circumferential surfaces having recessed and raised portions which engage each other.

* * * * *